United States Patent [19]

Schmidt

[11] Patent Number: 4,472,092

[45] Date of Patent: Sep. 18, 1984

[54] FABRICATION OF METAL SHELL GOLF CLUB HEADS

[76] Inventor: Glenn H. Schmidt, 1854 Los Encinos, Glendale, Calif. 91208

[21] Appl. No.: 406,337

[22] Filed: Aug. 9, 1982

[51] Int. Cl.[3] ..... B22C 9/04; B22C 13/12

[52] U.S. Cl. ..... 164/35; 164/186; 164/369; 164/45

[58] Field of Search ..... 164/45, 246, 44, 369, 164/34–36, 186; 264/221, 317, DIG. 55; 249/61, 62

[56] References Cited

U.S. PATENT DOCUMENTS

| | | | |
|---|---|---|---|
| T952,006 | 11/1976 | Hausch | 264/317 X |
| 2,356,380 | 8/1944 | Chollar . | |
| 2,420,851 | 5/1947 | Zahn et al. | 164/35 |
| 3,395,206 | 7/1968 | Schneider | 264/221 X |
| 3,405,212 | 10/1968 | Fraser et al. . | |
| 3,410,942 | 11/1968 | Bayer . | |
| 3,463,848 | 8/1969 | St. Clair . | |
| 3,601,178 | 8/1971 | Marticorena . | |
| 3,838,728 | 10/1974 | Voegeie . | |
| 4,289,191 | 9/1981 | Myllymaki | 164/45 |

*Primary Examiner*—Kuang Y. Lin

*Attorney, Agent, or Firm*—William W. Haefliger

[57] ABSTRACT

The method of fabricating a metal shell golf club head includes forming a core to the form of the inside surface of the shell; forming a plug integral with the core to project outwardly therefrom, the plug formed to outline peripheral shape conforming to the inner peripheral edge of a sole plate opening in the head shell; forming at least one gripper finger opening and at least one locking recess in the side of the plug, the core characterized as being soluble in a fluid solvent; forming a wax shell about the core while locating the plug in fixed position in a mold to hold the core in predetermined position and while maintaining a locking plunger in the formed recess; and removing the core and plug relative to the wax shell by dissolving the core and plug in the solvent; the core being transferred between stations (at which the (a) and (b) steps are carried out) by gripping and bodily displacing the plug which is integral with the core.

15 Claims, 13 Drawing Figures

FABRICATION OF METAL SHELL GOLF CLUB HEADS

BACKGROUND OF THE INVENTION

This invention relates generally to the production of thin walled, metal golf club heads, such as woods. More particularly it concerns method and apparatus for achieving much higher rates of production of such heads than was previously possible.

There is presently a high demand for golf clubs having wood heads consisting of a hollow steel shell filled with plastic material. Manufacture of such heads involves the use of multiple section patterns around which a wax shell is formed, the wax having the form of the ultimate steel shell to be produced, by the lost wax process. The wax shells are fragile, and are frequently damaged or destroyed in the process of removing the multiple section patterns from the shell interior, as via a "sole plate" opening in the bottom of the shell. Also such removal is very time consuming, and hence costly. There is need for process and apparatus which overcomes these very substantial problems.

SUMMARY OF THE INVENTION

It is a major object of the invention to provide process and apparatus which meets the above need. Basically, the invention in its process aspects involves the steps:

(a) forming a core having the exterior form of the inside surface of the wax shell (or club head metal shell to be produced), and forming a plug integral with that core to project outwardly therefrom, the core characterized as soluble in a fluid solvent;

(b) forming the wax shell about the core while locating the plug in fixed position to hold the core in predetermined position for wax application; and (c) removing the core and plug relative to the wax shell after hardening thereof, such removal including dissolving the core in the solvent.

As will be seen, the plug and core typically are formed at the same time as a one-piece unit, although the plug may be separated from and attached to the core. Also, the plug and core may consist of synthetic resin and be simultaneously soluble.

Further, the plug is typically formed to project outwardly from the bottom of the core corresponding to the sole area of the steel head shell to be formed; and an auxiliary pin plug may be integrally formed with the core at the location of the club hosel to be formed by the lost wax process.

It is a further object of the invention to provide an automated process for forming such cores, plugs and wax shells in a rapid manner. To this end, core and plug formation by molding may be carried out at a first station; wax shell formation or molding about the core may be carried out at a second station; and the core may be readily transferred between those stations, and from the second station, by gripping and bodily displacing the plug, as for example by robot or other mechanism, or even manually. As will be seen, the plug is used as a locater for the core at the wax shell molding station, whereby the core is accurately positioned in its mold recess, to maintain the small tolerances necessary for molding the thin wax shell which must faithfully and accurately duplicate the steel shell to be molded.

These and other objects and advantages of the invention, as well as the details of an illustrative embodiment, will be more fully understood from the following description and drawings in which:

DRAWING DESCRIPTION

FIG. 1 is a section through a core and a wax shell on the core, used in forming a golf club head;

FIG. 1*a* is a section through a hollow metal golf club head;

FIG. 2 is a view taken on lines 2—2 of FIG. 1;

FIG. 2*b* is an elevation;

DETAILED DESCRIPTION

Figure 1:
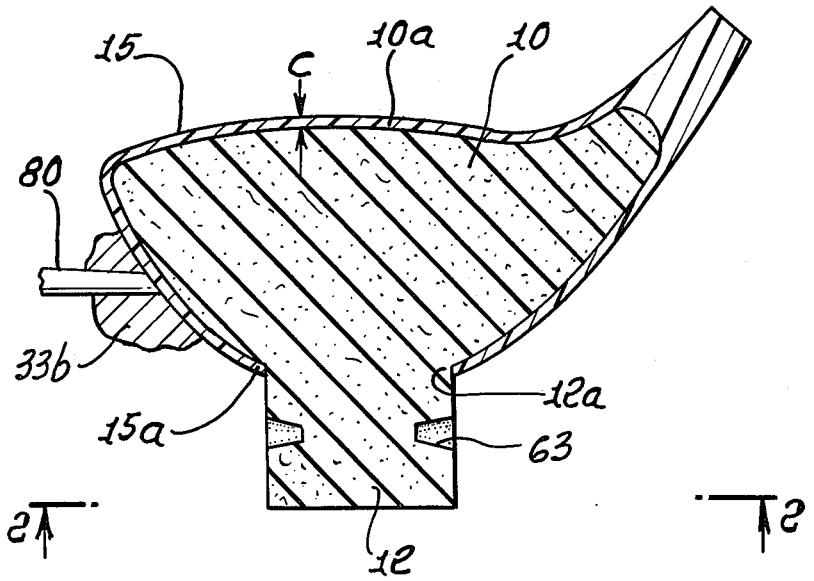
Figure 2:
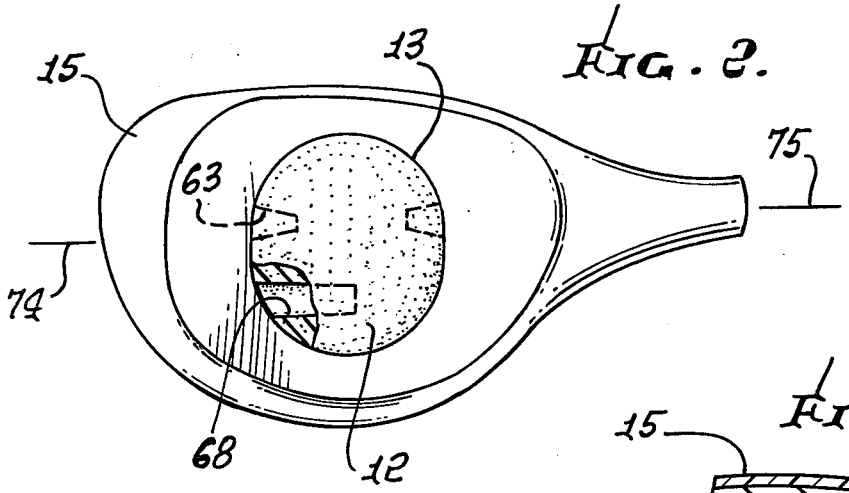
Figure 1A:
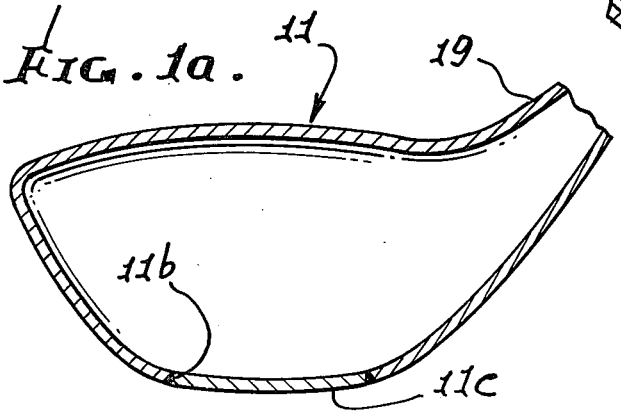

Referring first to FIGS. 1 and 2, it will be noted that a synthetic resinous core 10 is provided to have the exterior form of the inside surface of a hollow metal golf club head (wood). On such completed head shell appears in section at 11 in FIG. 1*a*. The exterior surface of the core having the indicated shape as designated at 10*a*.

Also formed to be integral with the core 10 is a plug or boss 12, which projects outwardly from the core. While the plug projects outwardly from the "bottom" of the core, as shown, it may extend in other directions. The plug is specifically shown as having an outer oval surface 13 conforming to the inner edge 11*b* of a sole plate opening in the head shell in FIG. 1*a*. A metal sole plate 11*c* is normally edge welded to that edge or periphery 11*b*, after the shell 11 is formed. The core and plug typically define a single integral body of material soluble in a fluid solvent. For example, the core and plug may consist of styrofoam, soluble in acetone or ketone. Other synthetic resins and solvents may be used.

Figures 2B, 4:
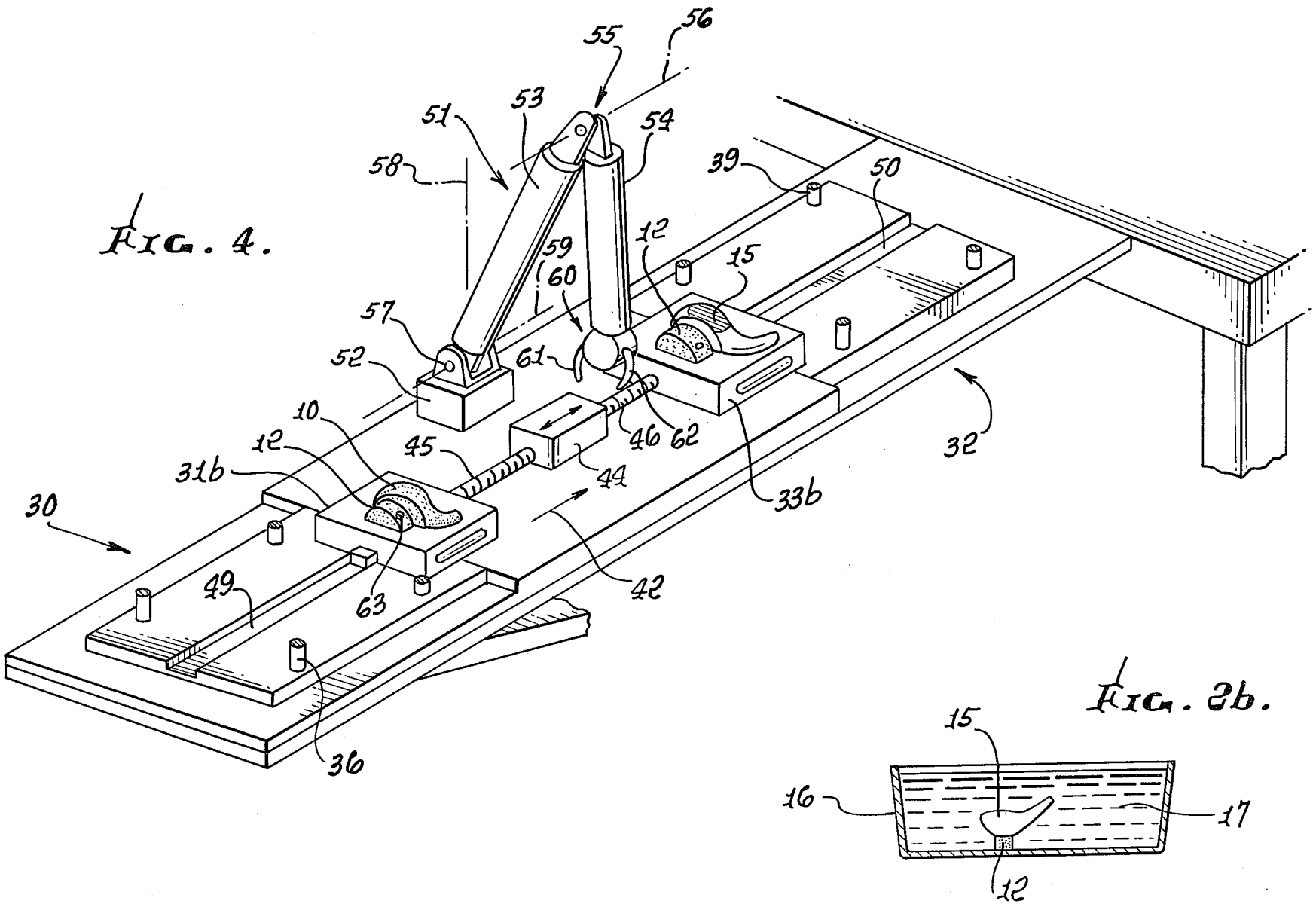
FIG. 4 is a perspective view showing molding and transfer apparatus to form the core, and the wax shell thereon.

After the core and plug are formed, a wax shell 15 is formed about the core, to a thickness equal to the metal shell 11 ultimately to be cast. The wax shell extends at 15*a* at the underside of the core, and about the plug extent 12*a* closest to the core. Thus, the remainder of the plug projects "through" the shell, and free thereof, so that the plug can be lifted and moved, thereby lifting and transferring the delicate wax shell, as required. Ultimately, the shell, core and plug are placed in a position wherein the core and plug are dissolved. See for example FIG. 2*b* showing tank 16 containing solvent 17 that dissolves the plug and core, leaving the delicate hollow wax shell in intact condition, for further use in forming the hollow steel shell 11.

Figure 3:
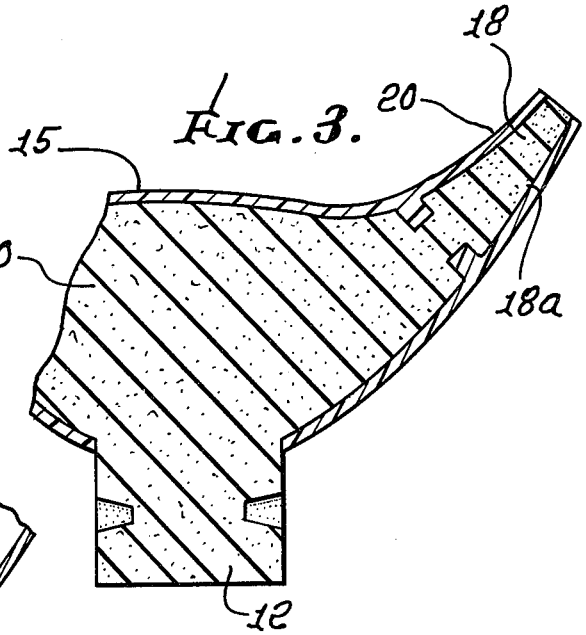
FIG. 3 is a view like FIG. 1, showing a modification.

FIG. 3 shows an additional or alternate "pin" plug 18 integral with core 10 and formed for projecting outwardly from a side of the core. Plug 18 has an exterior surface 18*a* conforming to the interior surface of the hosel 19 of the head, shown in FIG. 1*a*. Wax is shown at 20 about the pin plug, in the shape of that hosel. The pin plug is also dissolved out of the wax, in the step shown in FIG. 2*b*.

AUTOMATED METHOD AND APPARATUS

It is an important object of the invention to provide method and apparatus for automating the production of the wax shells 15 (and also wax hosels 20), so that production costs can be lowered, and damage to the wax shells previously due to excessive handling can be reduced or eliminated. Also high production rates can thereby be achieved.

Referring to FIGS. 4–7, one form of apparatus is there shown for achieving these objectives. Note in this regard that the existence of the plug 12, and/or pin plug 18, facilitates or makes possible the use of such apparatus, since it is the plug which is mechanically grasped and transferred, to transfer the core, and subsequently the core and wax shell, between stations, i.e. the fragile wax shell is never grasped by the transfer apparatus.

Figure 5:
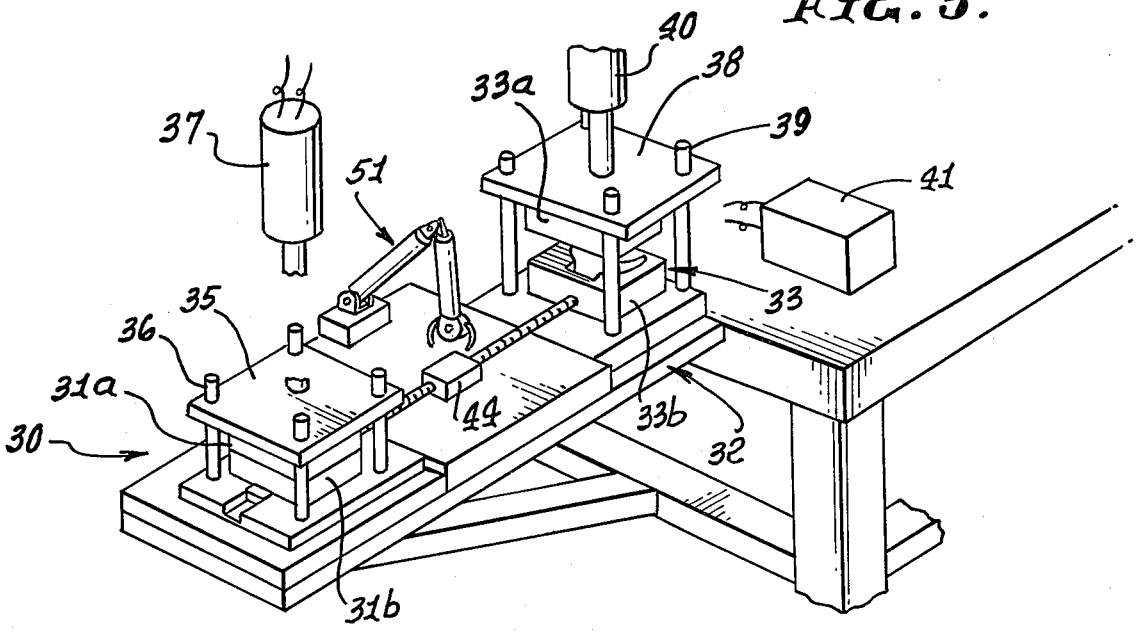
FIG. 5 is a perspective view showing the FIG. 4 apparatus in more complete form.
Figure 6:
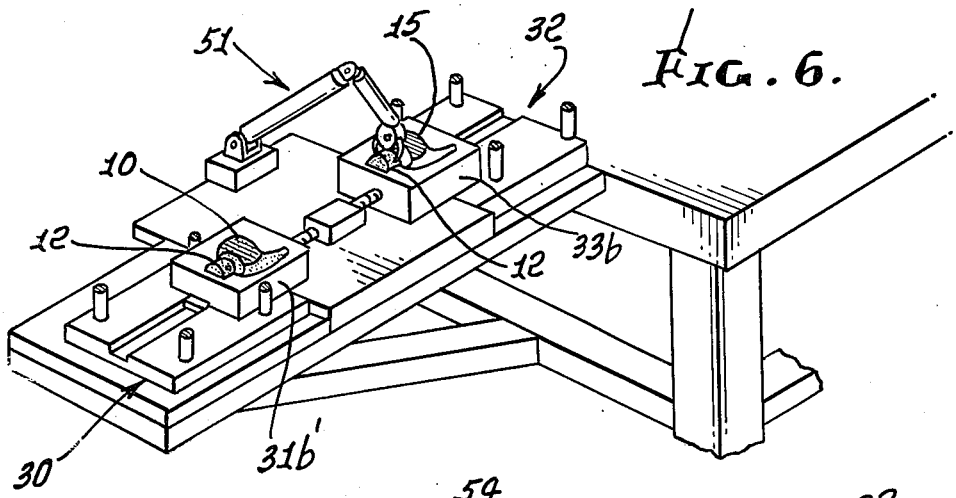
FIG. 6 is a view like FIG. 5, showing a transfer operation.
Figure 7:
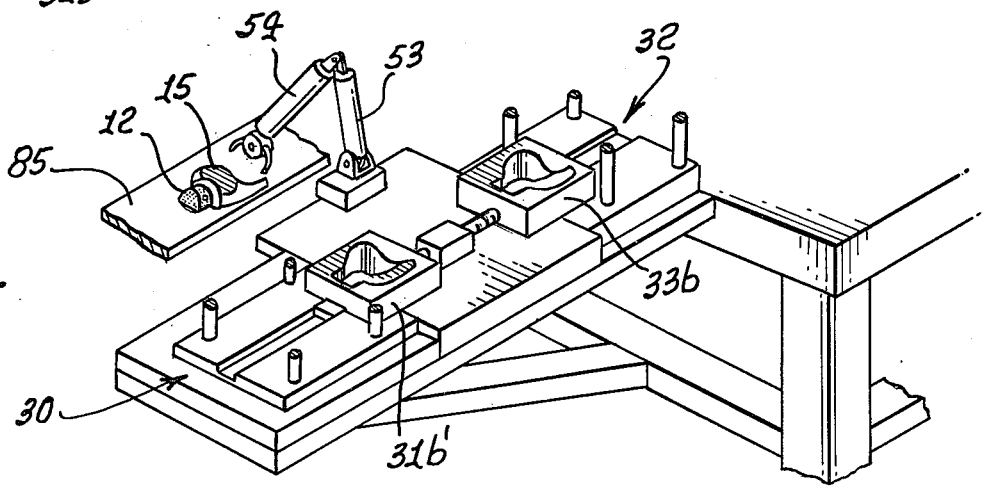
FIG. 7 is a perspective view showing another transfer operation.
Figure 8:
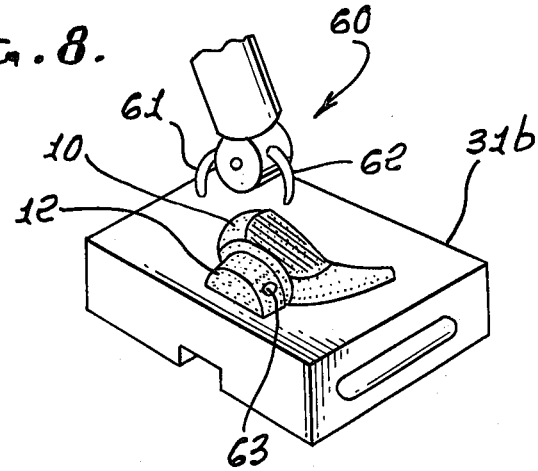
FIGS. 8–11 are fragmentary perspective views showing automated transfer of the mold core and wax shell.
Figure 9:
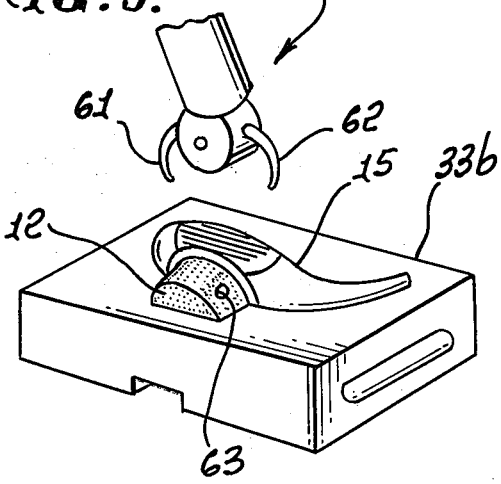
Figure 10:
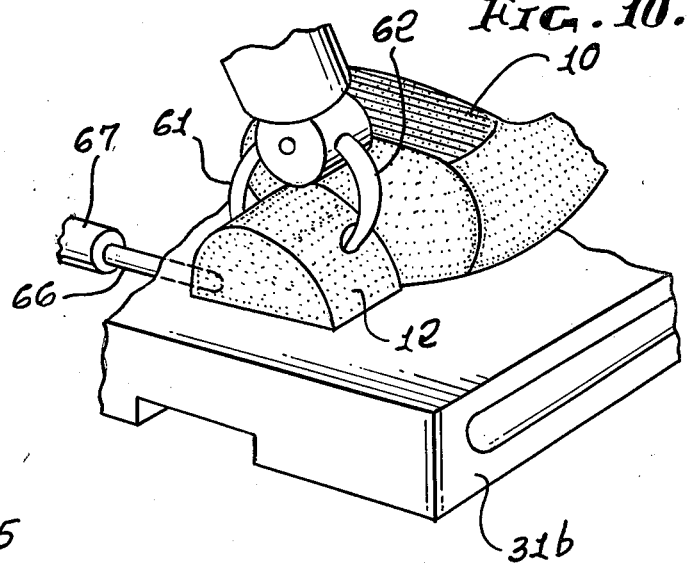
Figure 11:
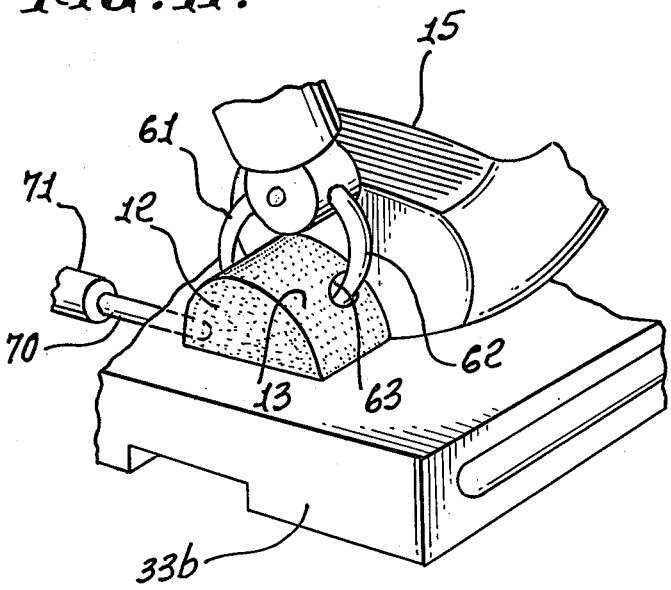

In FIGS. 5, 6 and 7, a first station is generally indicated at 30, and it will be understood that formation of the core 10 and plug 12 takes place in mold 31, which includes upper and lower mold sections 31*a* and 31*b*. A second station is generally indicated at 32, and it will be understood that when the core is transferred to that station, formation of the wax shell 15 about the core takes place in mold 33, which includes upper and lower mold sections 33*a* and 33*b*. Upper mold section 31*a* is raised and lowered relative to lower mold section 31*b* via platen 35 movable on guide pins 36. Actuator 37 raises and lower that platen. Likewise, upper mold section 33*a* is raised and lowered relative to lower mold section 33*b* via platen 38 movable on guide pins 39. Actuator 40 raises and lowers that platen. Control system 41 controls energization of the actuators, in timed relation.

The lower mold section 31*b* is movable in a direction indicated by arrow 42 in FIG. 4, out from under the upper mold section 31*a*, as by actuator 44 connected at 45 with section 31*b*. The actuator is also connected at 46 with lower mold section 33*b*, to move the latter into and out of position under raised mold section 33*a*. Note guideways 49 and 50 for guides on the lower mold sections. When the mold sections 31*b* and 33*b* are in FIG. 4 positions, i.e. out from under their respective mold sections, they may be regarded as having first and second sub-station positions.

A robot 51 is carried at 52, and has arms 53 and 54 pivotally connected at 55, to relatively pivot about horizontal axis 56. Arm 53 is pivotally mounted at 57 to pivot about a vertical axis 58, and also about horizontal axis 59. Claw 60 at the end of arm 54 has fingers 61 and 62 that are relatively movable toward and away from one another, thereby to grasp and elevate the plug 12, as via recesses 63 in the plug that receive the fingers. Recesses 63 are indicated in FIGS. 1 and 2. Suitable robot actuators are controlled by control system 41.

See also FIGS. 8–11.

Steps in the method of operation are summarized as follows:

1. Mold 31 closes, and core material is injected into that mold via line 65, to form the core.
2. Core mold is opened, by elevating mold section 31*a*.
3. Core mold section 31*b* is moved out from beneath section 31*a* to the first sub-station or holding position indicated at 31*b*′ in FIGS. 4 and 7.
4. The robot swings, and inserts fingers 61 and 62 into the plug recesses 63. See FIGS. 8 and 10.
5. A core stabilizing piston 66 is retracted from the plug 12, as by actuator 67. (note the recess 68 in the plug 12, in FIG. 2, to receive that piston).
6. The robot retracts (elevates) the plug from the mold section 31*b*.
7. The robot moves the plug and core into position over the lower section 33*b* of the pattern mold, which is out from under upper section 33*a*.
8. The robot moves the plug into its receptacle 69 in the mold section 33*b* (see FIG. 11), and stabilizing piston 70 is advanced into recess 68 in the plug. Note actuator 71 for piston 70. At this time, there is clearance "c" between the pattern mold and the core 12, equal to the thickness of the wax shell to be molded about the core. See FIG. 1, in this regard.
9. The robot's fingers are retracted, and the robot claw is retracted from the plug.
10. The pattern mold lower section 33*b* is displaced from second sub-station or holding position to position under the upper section 33*a*, and the latter is lowered. See parting lines 74 and 75 in FIG. 2. Clearance "c" exists about the core 12, and between both mold sections and the core. The dimension of "c" vary in accordance with the design of the club head to be produced.
11. Wax is injected at 80 (FIG. 1) into "c", i.e. into the cavity, and is allowed to harden.
12. Pattern mold upper section 33*a* is elevated, and the lower section 33*b* is displaced outwardly to the position seen in FIG. 4.
13. The robot claw is moved over the plug (see FIG. 9) and is operated to insert fingers 61 and 62 into recesses 63. Thereafter, stabilizing or locating pin 70 is retracted.
14. The robot lifts the plug from the mold section 33*b*, and the core and wax shell 15 are also freed and elevated.
15. The robot arm then displaces the plug; core and wax shell onto a receiver 85, such as a conveyor seen in FIG. 7.
16. The conveyor carries the plug, core and wax shell, as a unit to a solubilizing location, as for example tank 16 seen in FIG. 2*b*, and described above, where the core and plug are dissolved, and the wax shell is left free.
17. The wax shell is employed in a known "lost wax" process to produce the steel head i.e. shell 11 of the golf club.

I claim:

1. In the method of fabricating a metal shell golf club head, the steps that include (a) forming a core to the form of the inside surface of the head shell, forming a plug integral with said core to project outwardly therefrom, the plug formed to outer peripheral shape conforming to the inner peripheral edge of a sole plate opening in the head shell, and forming at least one gripper finger opening in the side of the plug and at least one locking recess in the side of the plug, said core characterized as being soluble in a fluid solvent, (b) forming a wax shell about the core while locating the plug in fixed position in a mold to hold the core in predetermined position, and while maintaining a locking plunger in said recess, (c) removing the core and plug relative to the wax shell, said removing including dissolving the core and plug in said solvent, (d) said step (a) being carried out at a first station and said step (b) being carried out at a second station, and including transferring the core between said stations by introducing a gripper finger into said gripper finger opening and bodily displacing the finger and plug, (e) forming said metal shell golf club head with a lost wax process.

2. The method of claim 1 wherein said plug and core consist of synthetic resin, and the plug is formed during formation of the core.

3. The method of one of claims 1 and 2 wherein said plug is formed to project outwardly from the bottom of the core corresponding to the sole of the head.

4. The method of claim 3 including forming a second plug integral with the core to project outwardly as a pin from a side of the core corresponding to the hosel of the head.

5. The method of claim 1 employing a first mold, at a first station with a first cavity in which the core and plug are formed, and employing a second mold at a second station with a second cavity in which said (b) step is carried out.

6. The method of claim 5 including locking the plug in the second mold while said (b) step is carried out, the second mold including sections which are relatively separable, and including separating said sections while the plug remain locked to one of the sections.

7. The method of claim 6 wherein said locking step is carried out by inserting a plunger into said plug locking recess, the plunger carried by the one section of the second mold.

8. The method of claim 5 wherein said first mold includes relatively openable mold sections, and said second mold includes relatively openable mold sections, and said transfer step includes displacing one section of the first mold with the core therein from said first station to a first sub-station, then gripping and bodily displacing the plug as aforesaid to transfer the core into one section of the second mold at a second sub-station, and then displacing said one section of the second mold with the core therein to said second station.

9. The method of claim 8 including providing a robot arm having a gripping terminal, and using said arm and terminal to carry out said gripping and bodily displacement of the plug, as aforesaid.

10. The method of claim 1 including, after said (c) step, employing said wax shell in the fabrication of the metal shell golf club head through a lost wax process.

11. The method of claim 1 wherein said transferring step includes transferring said core to a holding zone, holding said core at said zone to permit at least partial curing of said resinous core, and then transferring said core from said zone to said second station.

12. The method of claim 5 wherein the second mold has a receiver recess communicating with said cavity therein, and including placing and locating the plug in the receiver recess so as to locate and retain the core in predetermined position in said second cavity.

13. The method of claim 12 including temporarily locking the plug in said receiver recess.

14. In combination:

(a) a solid soluble core having the exterior shape of the inside surface of a metal shell head of a golf club, and (b) a plug attached to the core and projecting therefrom for grasping, thereby to transfer the core to and from a location at which a wax shell is formed about the core (c) the plug containing a recess to receive a locating pin, (d) the plug also containing a least one gripping finger recess to receive a finger or fingers of a robot operable to lift the plug from a first mold section and to lower the plug onto a second mold section, and (e) including said robot having said finger or fingers in said recess or recesses.

15. The combination of claim 14 including first and second work stations, a core and plug molding apparatus at the first station, and a wax molding apparatus at the second station, and transfer actuator means operatively connected with sections of said molding apparatus to transfer the sections to and from the work stations, the sections having receivers for the plug which supports the core.

* * * * *